US005335043A

United States Patent [19]

Kluger et al.

[11] Patent Number: 5,335,043

[45] Date of Patent: Aug. 2, 1994

[54] SHEET MISFEED AND JAM DETECTION BY MEASURING FORCE EXERTED ON FEED ROLLS

[75] Inventors: Jacob N. Kluger; Michael J. Martin; Steven R. Moore; Russell J. Sokac, all of Rochester, N.Y.

[73] Assignee: Xerox Corporation, Stamford, Conn.

[21] Appl. No.: 801,553

[22] Filed: Dec. 2, 1991

[51] Int. Cl.[5] ..... G03G 21/00

[52] U.S. Cl. ..... 355/206; 271/258; 355/209

[58] Field of Search ..... 355/203, 204, 205, 206, 355/207, 209; 340/674, 665, 668; 271/256, 258

[56] References Cited

U.S. PATENT DOCUMENTS 3,778,051 12/1973 Allen et al. ..... 271/57
4,166,615 9/1979 Noguchi et al. ..... 271/259
4,203,586 5/1980 Hoyer ..... 271/263 X
4,396,187 8/1983 Landa ..... 271/258
4,591,145 5/1986 Cherian ..... 271/258

FOREIGN PATENT DOCUMENTS 157654 9/1983 Japan .

*Primary Examiner*—Benjamin R. Fuller
*Assistant Examiner*—J. E. Barlow, Jr.

[57] ABSTRACT

An apparatus to detect sheet misfeeds and jams in an electrophotographic printing machine by measuring the tangential reaction force of a sheet entering the nip between two drive rolls and comparing the measured force with preprogrammed parameters within the machine controller. In the event the force measured does not fall within the programmed parameters, the drive motor controller and machine controller can take appropriate corrective action to display an error message, lessen sheet damage and prevent machine damage. A force library can be compiled to predict drive roll wear and failure so as to allow preventative measures to be taken.

4 Claims, 3 Drawing Sheets

SHEET MISFEED AND JAM DETECTION BY MEASURING FORCE EXERTED ON FEED ROLLS

This invention relates generally to a sheet misfeed and jam detection device, and more particularly concerns a device to measure the drive force required for a paper transport roll for use in an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In an electrophotographic printing machine, as described above, it is imperative that any misfeeding or jamming of the copy sheets is recognized as soon as possible and appropriate steps taken to prevent damage to the photoconductive member, the copy sheet, or other portions of the machine. Particularly, with the advent of today's high-speed electrophotographic printing machines, if a misfeed or a paper jam is not detected and acted upon quickly, serious consequences can arise and damage to the machine may result.

There are various devices known in the art for detecting either a paper jam or the duplicate or multiple feeding of copy sheets within an electrophotographic printing machine. Devices such as mechanical trip switches, optical sensors and station-to-station timing devices have been utilized. Each of the above devices, however, has its own inherent problems. Mechanical sensors in order to not interrupt the paper flow must present minimal restriction to the paper. A device that is delicate enough so that it does not interfere with the paper flow may not positively control a switch to effect the proper machine action in the event of a jam or may require a switch so sensitive that false readings are obtained. Optical sensors are subject to contamination from paper particles, grease or other contaminates within the machine itself and further are subject to degradation of the electrical components. Additionally, optical sensors which usually are only able to detect the presence or absence of a sheet, may not react quickly enough or may be non-responsive to certain types of misfeeds and/or paper jams unless large arrays of sensors are disposed throughout the machine. Station-to-station timing devices, while providing a fairly reliable measure as to the proper flow path, do not necessarily indicate where a problem arises thus necessitating further diagnostic measures to pinpoint a problem.

It is an object of the present invention to provide a device which will monitor the copy sheet flow through the printing process and detect variations of the normal operating parameters. By detecting these variations, errors such as multiple sheet feeds, paper jams and other misfeeding of copy sheet can be detected and appropriate action signaled to the machine controller, so as to allow automatic correct,on of the problem and salvaging of the misfed sheet. Additionally, model machine operating parameters can be stored and compared with the measured forces to allow preventative measures to be performed prior to machine failures.

The following disclosures may be relevant to various aspects of the present invention:

U.S. Pat. No. 4,396,187 Patentee: Landa. Issued: Aug. 2, 1983

U.S. Pat. No. 4,166,615 Patentee: Noguchi, et al. Issued: Sep. 4, 1979

U.S. Pat. No. 3,778,051 Patentee: Allen, et al. Issued: Dec. 11, 1973

The relevant portions of the foregoing disclosures may be briefly summarized as follows:

U.S. Pat. No. 4,396,187 discloses a sheet detection device which utilizes the presence of a sheet spanning two pairs of rollers which rollers are operating at slightly different speeds and the resultant retarding torque transmitted through the sheet of paper to signal the presence of the sheet at a certain destination.

U.S. Pat. No. 4,166,615 discloses a device which utilizes a speed variation recognition device between two pairs of rollers to indicate slippage and/or the failure of a sheet to reach a certain destination.

U.S. Pat. No. 3,778,051 describes a superposed sheet detecting apparatus which utilizes a transducer means disposed in an operable location to a sheet feeding mechanism and adapted to produce signals proportional to the thickness of the sheets of material fed past the location. A signal representative of the thickness is then compared to a stored signal and if the measured signal is not within a certain parameter, an error message or error signal is activated.

In accordance with one aspect of the present invention, there is provided an apparatus for detecting sheet misfeeds and jams. The apparatus comprises sheet advancing means operatively associated with means for measuring the force applied by the sheet in the advancing means. Means for comparing the measured force with a reference force generates an error signal indicative of the difference therebetween.

Pursuant to another aspect of the present invention, there is provided an electrophotographic printing machine of the type in which a sheet is advanced in a primary sheet feeding direction and in which sheet misfeeds and jams are detected. The improvement comprises sheet advancing means operatively associated with means for measuring the force applied by the sheet in said advancing means. Means for comparing the measured force with a reference force, generates an error signal indicative of the difference therebetween.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
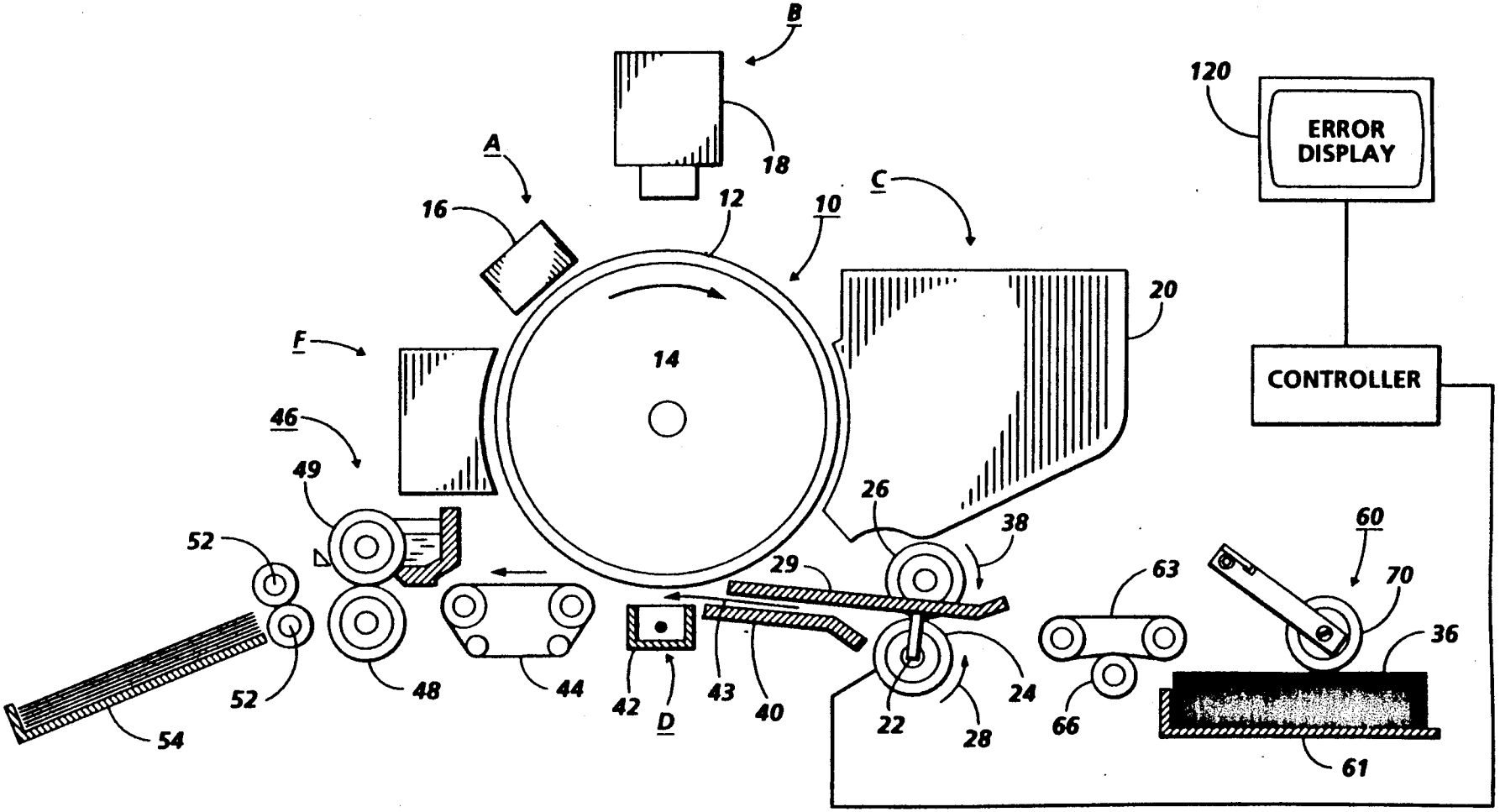
FIG. 1 is a schematic elevational view depicting an illustrative electrophotographic printing machine incorporating the misfeed and jam detection device of the present invention therein.

For a general understanding of an electrophotographic printing machine in which the features of the present invention may be incorporated, reference is made to FIG. 1 which depicts schematically the various components thereof. Hereinafter, like reference numerals will be employed throughout to designate identical elements. Although the apparatus for detecting sheet misfeeds and jams is particularly well adapted for use in the electrophotographic printing machine of FIG. 1, it should become evident from the following discussion that it is equally well suited for use in a wide variety of devices and is not necessarily limited in this application to the particular embodiment shown herein.

Since the practice of electrophotographic printing is well known in the art, the various processing stations for producing a copy of an original document are represented in FIG. 1 schematically. Each processing station will be briefly described hereinafter.

As in all electrophotographic printing machines of the type illustrated, a drum 10 having a photoconductive surface 12 entrained about and secured to the exterior circumferential surface of a conductive substrate is rotated in the direction of arrow 14 through the various processing stations. By way of example, photoconductive surface 12 may be made from selenium. A suitable conductive substrate is made from aluminum.

Initially, drum 10 rotates a portion of photoconductive surface 12 through charging station A. Charging station A employs a conventional corona generating device, indicated generally by the reference numeral 16, to charge photoconductive surface 12 to a relatively high substantially uniform potential.

Thereafter drum 10 rotates the charged portion of photoconductive surface 12 to expose station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the informational areas contained within the original document. Obviously, electronic imaging of page image information could be used, if desired.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 1, a copy sheet is advanced by retard sheet feeding apparatus 60 to transfer station D. Nudger roll 70 of sheet feeding apparatus 60 advances one or more copy sheets to a retard nip defined by belt 63 and roller 66. Retard roll 66 applies a retarding force to shear any multiple sheets from the sheet being fed and forwards it to registration roller 24 and idler roller 26. Registration roller 24 is driven by a motor (now shown) in the direction of arrow 28 and idler roller 26 rotates in the direction of arrow 38 since roller 24 is in contact therewith. In operation, feed device 60 operates to advance the uppermost sheet from stack 36 into registration rollers 24 and 26 and against registration fingers 22. Fingers 22 are actuated by conventional means in timed relation to an image on drum 12 such that the sheet resting against the fingers is forwarded toward the drum in synchronism with the image of the drum. The sheet is advanced in the direction of arrow 43 through a chute formed by guides 29 and 40 to transfer station D.

Continuing now with the various processing stations, transfer station D includes a corona generating device 42 which applies a spray of ions to the back side of the copy sheet. This attracts the toner powder image from photoconductive surface 12 to copy sheet.

After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by rollers 52, which may be of the same type as registration rollers 24 and 26, to catch tray 54.

Invariably, after the copy sheet is separated from photoconductive surface 12, some residual toner particles remain adhering thereto. These toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts the drive roll force measurement system in greater detail.

Figure 2:
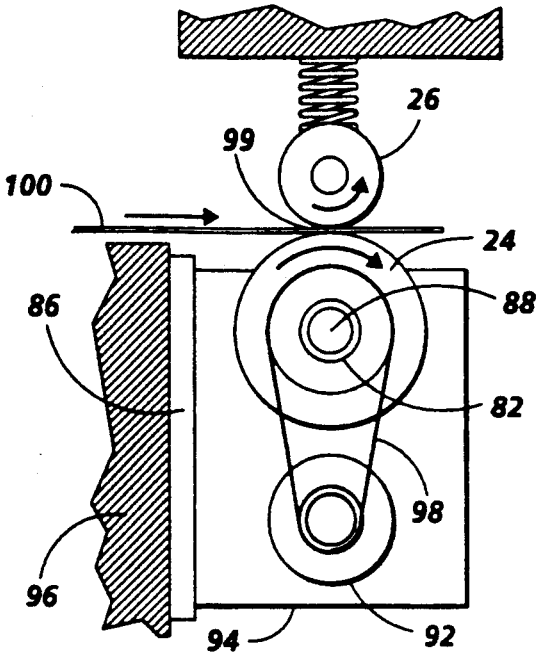
FIG. 2 is a detailed partial schematic illustrating the arrangement of the drive motor, drive roll and jam detection device.

FIG. 2 shows a detailed end view of paper transport rolls 24, 26 in FIG. 1 including the drive motor 92 which is not shown in FIG. 1. The drive roll shaft 88 is supported by a bearing 82 which bearing 82 is, along with the drive motor 92, securely mounted to the electrophotographic copying machine housing (not shown) on a common mounting block 94. Between the solid bearing/motor mounting block 94 and the machine frame 96, the force transducer 86 can be seen. A spring loaded idler roller 26 is mounted so that the idler maintains contact with the drive roller 24 and rotates in the same direction as the drive roller 24. A nip 99 is created at the point where the idler roller 26 and drive roller 24 contact each other. In this mounting configuration, the only external forces acting on the drive motor/roll assembly are its own weight, the nip normal force, and the rolls tangential reaction with a sheet in the nip. The tangential drive force is the frictional force transmitted by the drive roller 24 to the sheet 100. The tangential sheet reaction force in response to the tangential drive force can be measured by the force transducer 86. The transducer 86 will emit an electrical signal proportional to the force measured by it. Force transducers of the piezoelectric film type or strain gauge type transducers may be utilized to measure the reaction force.

As the sheet 100 enters the nip 99 between the drive roller 24 and idler roller 26, there is a reaction force opposite the tangential drive force of the drive roll. A single sheet will have substantially the same force reading each time it enters the roll nip. In the event of a double sheet entering the nip, or of a jam in the stream of sheets leaving the nip, the reaction force will be proportionately larger and this larger reading can be transmitted to the driver motor controller for the drive roller. The drive roller can be stopped, an error message displayed on a monitor 120 for the operator, and the sheet automatically removed from the roller by reversing the appropriate drive nip to prevent damage to the sheets and/or machine. Other appropriate actions can then be taken by the machine controller to prevent other jams within the processes.

As previously mentioned, there will be a standard substantially equal reaction force for a single sheet of each paper weight that enters the drive roll nips. This standard force can be monitored and timed to that in the event that the expected force is not exerted within a specified time between sheets, a signal is sent to the drive motor controller and the machine controller so that appropriate action can be taken to correct the jam.

Drive roll wear can also be monitored by recording the history of these reaction forces. As the drive rolls wear, the reaction force over time will lessen and when the force reaches a certain predetermined level, the machine can alert service personnel that the rolls need replacing or adjustments are necessary.

Figure 2A:
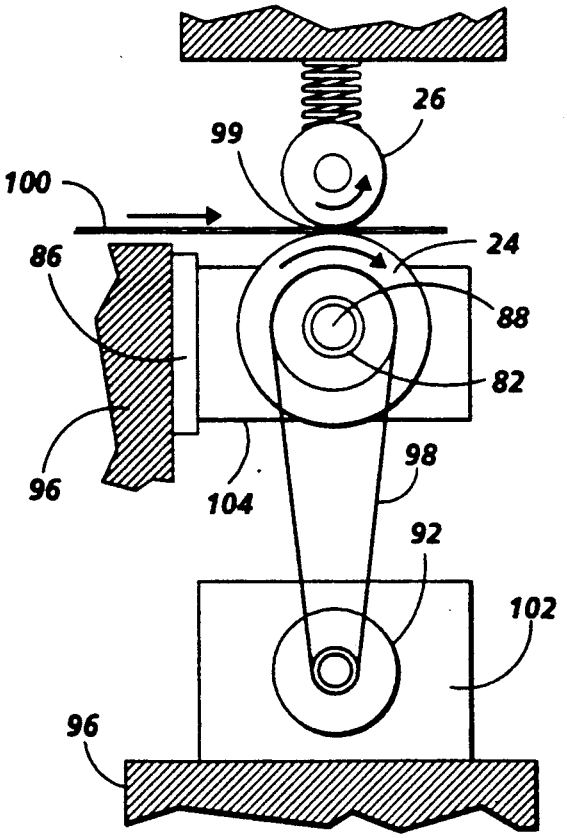
FIG. 2A is a detailed partial schematic illustrating the arrangement of the drive motor, drive roll and jam detection device in a second embodiment.

FIG. 2A shows the same view as in FIG. 2 with the drive motor 92 mounted on a separate mounting block 102 from the drive roller mounting block 104, in a configuration so that the driving medium 98 (i.e. drive belt) does not absorb the tangential reaction force.

Figure 3:
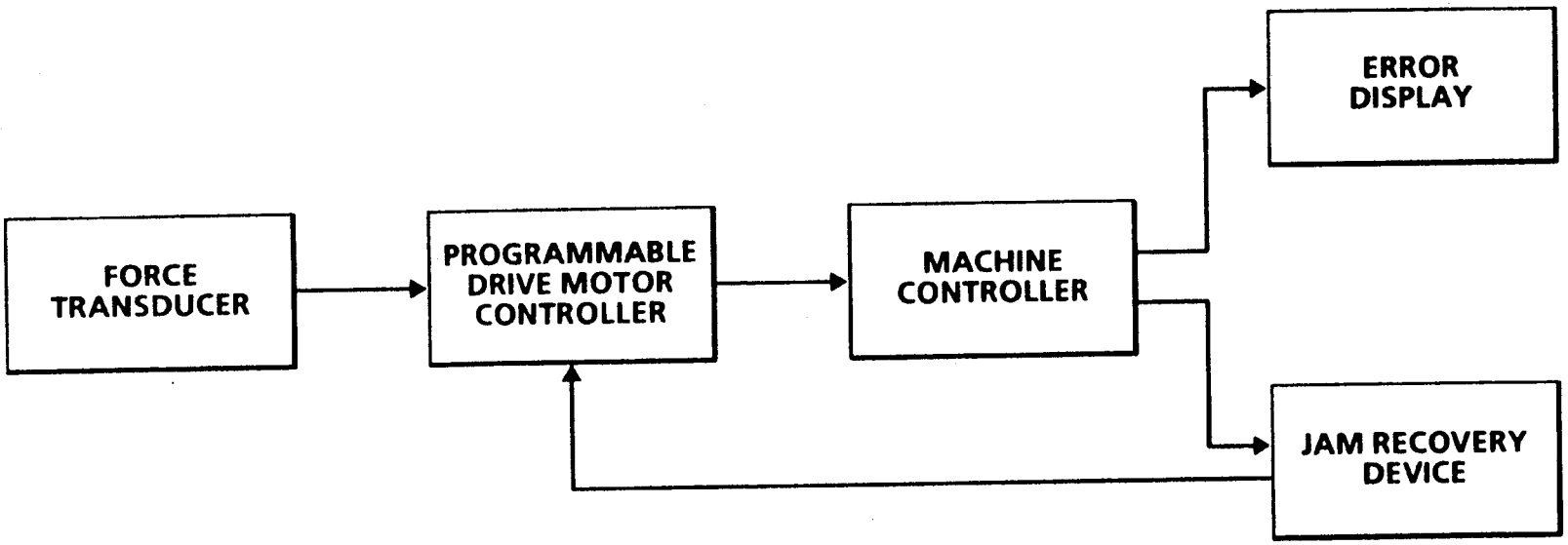
FIG. 3 is a schematic block diagram indicating the function of the present misfeed and jam detection device.

FIG. 3 demonstrates a block diagram of the interrelationship between the force transducer, the drive motor controller, machine controls and the recovery and error display devices. The previously described force transducer detects the tangential reaction force of the drive roller as the sheet passes between the drive roller and idler roller. A signal proportional to the force is transmitted to the programmable drive motor controller. The signal received by the motor controller is compared with benchmark levels established for normal operation. If the signal deviates from the benchmark level by more than an allowable tolerance, the drive motor is stopped and a further error signal sent to the machine controller. The machine controller causes an error message to be displayed to the operator and stops other machine processes to prevent further jams or misfeeds. Additionally, an automatic recovery device can be utilized to reverse the appropriate drive nip to remove the jammed sheet. Location specific error messages can be displayed on a monitor 120 to allow manual removal of the offending sheet or sheets from the paper path.

The present invention is adaptable to many stations in an electrophotographic commercial printing machine. Each data recording point of the present invention can operate independently of any other point. There is no need for comparison between multiple sets of rollers and/or stations in the machine. Additionally, for each point in a machine at which the present invention is utilized, an operating history or library can be developed and various parameters established to which the signals recorded during the operating mode must comport. By utilizing various individual points of reference, the exact location and the type of error can be easily and quickly detected and the appropriate shutdown and recovery procedures activated through the machine controller. Moreover, damage to the machine can be prevented as a result of the quick recognition of the error.

In recapitulation, the paper transport drive rolls and drive motors are mounted n such a manner that there is a force transducer located between the bearing mounting housings and the machine framework. The force transducers record the normal tangential reaction force of the sheets passing into the roller nips. The measured signal which is proportional to the reaction force is compared with a preprogrammed parameter to ensure that a single sheet of the proper weight is passing through the rolls. In the event of a deviation of this force reading, such as that which would occur as the result of multiple sheet feeding, or of a jam in the stream of sheets leaving the nip, thereby increasing the reaction force, a location specific error message is displayed, the drive roller is stopped by the motor controller and can additionally be reversed to remove the jammed sheet, and other machine controls take appropriate action to prevent the further jams throughout the machine process. The quick reaction time of the force measurement system also allows for the recovery of most jammed or misfed sheets. Moreover, by monitoring the reaction force over time, other preventative maintenance items such as roll replacement and abnormal roll wear can be determined. By using multiple applications of the present device, a jam or misfeed n virtually any station throughout the electrophotographic process can be determined and corrective measures taken by the machine controller The force transducers can also be used for any pair of rollers in an electrophotographic printing machine, i.e. in a document handler and/or a finishing station to monitor and prevent paper misfeeds and jams.

It is, therefore, apparent that there has been provided in accordance with the present invention, a sheet misfeed and jam detection device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for detecting sheet misfeeds and jams in a device having a supporting frame comprising:

means for advancing the sheet, wherein said advancing means comprises a pair of rolls coaxially parallel and disposed adjacent to each other so that the circumferential surface of the first roll is in contact with the circumferential surface of the second roll so as to form a nip, a drive shaft, a pair of bearings with one of said pair of bearings being mounted on opposed end regions of said drive shaft with each of said rolls being mounted in said bearings;

means operatively associated with said advancing means for measuring the force applied on the sheet in a direction substantially parallel to the direction of movement of the sheet by said advancing means as the sheet is advanced by said advancing means, said measuring means comprises a force transducer disposed between said bearings and the supporting frame;

means for comparing the measured force with a reference force and generating an error signal indicative of the difference therebetween; and means responsive to the error signal,for displaying misfeeding of the sheet;

a drive motor externally driving one of said rolls about its axis of rotation, said comparing means error signals being adapted to control said drive motor.

2. An electrophotographic printing machine of the type having a supporting frame in which a sheet is advanced in a primary sheet feeding direction and in which sheet misfeeds and jams are detected, wherein the improvement comprises:

means for advancing the sheet, wherein said advancing means comprises a pair of rolls coaxially parallel and disposed adjacent to each other so that the circumferential surface of the first roll is in contact with the circumferential surface of the second roll so as to form a nip, a drive shaft, a pair of bearings with one of said pair of bearings being mounted on opposed end regions of said drive shaft with each of said rolls being mounted in said bearings;

means operatively associated with said advancing means for measuring the force applied on the sheet in a direction substantially parallel to the direction of movement of the sheet by said advancing means as the sheet is advanced by said advancing means, said measuring means comprises a force transducer disposed between said bearings and the supporting frame of said electrophotographic printing machine;

means for comparing the measured force with a reference force and generating an error signal indicative of the difference therebetween; and means responsive to the error signal, for displaying misfeeding of the sheet;

a drive motor externally driving one of said rolls about its axis of rotation, said comparing means error signal being adapted to control said drive motor.

3. An apparatus for detecting sheet misfeeds and jams in a device having a supporting frame comprising:

means for advancing the sheet, wherein said advancing means comprises a pair of rolls coaxially parallel and disposed adjacent to each other so that the circumferential surface of the first roll is in contact with the circumferential surface of the second roll so as to form a nip, a drive shaft, a pair of bearings with one of said pair of bearings being mounted on opposed end regions of said drive shaft with each of said rolls being mounted in said bearings;

means operatively associated with said advancing means for measuring the force applied on the sheet in a direction substantially parallel to the direction of movement of the sheet by said advancing means as the sheet is advanced by said advancing means, said measuring means comprises a force transducer disposed between said bearings and the supporting frame;

means for comparing the measured force with a reference force and generating an error signal indicative of the difference therebetween;

means, responsive to the error signal, for displaying misfeeding of the sheet;

a mount; and a drive motor externally driving one of said rolls about its axis of rotation, said drive motor being commonly mounted with one of said driveshaft mounting bearings on said mount, said comparing means error signal being adapted to control said drive motor.

4. An electrophotographic printing machine of the type having a supporting frame in which a sheet is advanced in a primary sheet feeding direction and in which sheet misfeeds and jams are detected, wherein the improvement comprises:

means for advancing the sheet, wherein said advancing means comprises a pair of rolls coaxially parallel and disposed adjacent to each other so that the circumferential surface of the first roll is in contact with the circumferential surface of the second roll so as to form a nip, a drive shaft, a pair of bearings with one of said pair of bearings being mounted on opposed end regions of said drive shaft with each of said rolls being mounted in said bearings;

means operatively associated with said advancing means for measuring the force applied on the sheet in a direction substantially parallel to the direction of movement of the sheet by said advancing means as the sheet is advanced by said advancing means, said measuring means comprises a force transducer disposed between said bearings and the supporting frame of said electrophotographic printing machine;

means for comparing the measured force with a reference force and generating an error signal indicative of the difference therebetween;

means, responsive to the error signal, for displaying misfeeding of the sheet;

a mount; and a drive motor externally driving one of said rolls about its axis of rotation, said drive motor being commonly mounted with one of said driveshaft mounting bearings on said mount, said comparing means error signal being adapted to control said drive motor.

* * * * *